US008650730B2

(12) United States Patent
Sawdon

(10) Patent No.: US 8,650,730 B2
(45) Date of Patent: Feb. 18, 2014

(54) CLINCHING TOOL

(75) Inventor: Edwin G. Sawdon, St. Clair, MI (US)

(73) Assignee: BTM Corporation, Marysville, MI (US)

( * ) Notice: Subject to any disclaimer, the term of this patent is extended or adjusted under 35 U.S.C. 154(b) by 1370 days.

(21) Appl. No.: 12/390,658

(22) Filed: Feb. 23, 2009

(65) Prior Publication Data

US 2010/0212131 A1 Aug. 26, 2010

(51) Int. Cl.
*B23P 11/00* (2006.01)

(52) U.S. Cl.
USPC ..... 29/243.5

(58) Field of Classification Search
USPC ..... 29/243.5, 243.56, 243.53, 243, 252, 29/253, 270, 278, 237, 238, 243.523
See application file for complete search history.

(56) References Cited

U.S. PATENT DOCUMENTS

| | | | |
|---|---|---|---|
| 567,606 | A | 9/1896 | McCool et al. |
| 679,137 | A | 7/1901 | Baxter |
| 988,154 | A | 3/1911 | Thiemer |
| 1,190,696 | A | 7/1916 | Wilzin |
| 1,283,799 | A | 11/1918 | Kerr |
| 1,456,079 | A | 5/1923 | Stuebner |
| 1,509,997 | A | 9/1924 | Fry |
| 1,919,999 | A | 7/1933 | Borton |
| 1,926,686 | A | 9/1933 | Newton |
| 1,969,214 | A | 8/1934 | Dit Daude |
| 1,985,333 | A | 12/1934 | Wiley |
| 2,004,182 | A | 6/1935 | Arey |
| 2,254,558 | A | 9/1941 | Williams |
| 2,278,293 | A | 3/1942 | Watson |
| 2,333,966 | A | 11/1943 | Weiss |
| 2,393,986 | A | 2/1946 | Gullberg |
| 2,404,197 | A | 7/1946 | Sirp |
| 2,430,377 | A | 11/1947 | Vorreyer |
| 2,467,969 | A | 4/1949 | Debrot, Jr. |
| 2,555,836 | A | 6/1951 | Werich |
| 2,619,855 | A | 12/1952 | Williams |
| 2,626,687 | A | 1/1953 | Williams |
| 2,632,929 | A | 3/1953 | Poupitch |
| 2,663,072 | A | 12/1953 | Pfistershamer |

(Continued)

FOREIGN PATENT DOCUMENTS

| | | |
|---|---|---|
| AU | 206465 | 1/1957 |
| CA | 1237574 | 6/1988 |

(Continued)

OTHER PUBLICATIONS

Attexor Clinch Systems SA, "Clinching Products," © 2002 [online], [retrieved on Nov. 7, 2008]. Retrieved from the Internet: http://www.clinchsystems.com/html, 22 pages.

(Continued)

*Primary Examiner* — Lee D Wilson
*Assistant Examiner* — Nirvana Deonauth
(74) *Attorney, Agent, or Firm* — Harness, Dickey & Pierce, P.L.C.

(57) ABSTRACT

A clinching tool is provided. A further aspect of the present application locates an anvil and/or movable die members closer to one lateral outside surface of a die body than the opposite lateral outside surface. In another aspect, an offset clinch die and pneumatic tool are employed. Another aspect includes a die body having an anvil and two linearly movable die members which essentially surround a lateral outside surface of the anvil when in inward positions.

33 Claims, 10 Drawing Sheets

(56) References Cited

U.S. PATENT DOCUMENTS 2,671,361 A 3/1954 Sandberg
2,685,719 A 8/1954 Golden
2,688,890 A 9/1954 Williams
2,713,197 A 7/1955 Schmidt
2,811,880 A 11/1957 Williams
2,865,451 A 12/1958 Ihrig
2,924,312 A 2/1960 Williams
2,937,681 A 5/1960 Patten
3,022,687 A 2/1962 Richards
3,157,942 A 11/1964 MacLean, Jr.
3,177,914 A 4/1965 MacLean, III et al.
3,178,749 A 4/1965 Heepe
3,187,796 A 6/1965 Double
3,198,155 A 8/1965 Fraze
3,202,112 A 8/1965 Oakley
3,315,345 A 4/1967 Double et al.
3,324,491 A 6/1967 Gutshall
3,338,463 A 8/1967 Henrickson
3,357,388 A 12/1967 Dunn
3,359,935 A 12/1967 Rosbottom
3,404,648 A 10/1968 Rosbottom
3,439,723 A 4/1969 Double et al.
3,451,367 A 6/1969 Henrickson
3,469,613 A 9/1969 Steward
3,470,596 A 10/1969 Belada
3,506,050 A 4/1970 Pouch et al.
3,579,809 A 5/1971 Wolf et al.
3,599,318 A 8/1971 Behlen
3,615,274 A 10/1971 Belada
3,726,000 A 4/1973 Hafner
3,730,044 A 5/1973 Sawdon
3,771,216 A 11/1973 Johnson
3,791,016 A 2/1974 Eberhardt et al.
3,810,290 A 5/1974 Grube
3,828,517 A 8/1974 Johnson
3,829,957 A 8/1974 Pouch et al.
3,862,485 A 1/1975 Hafner
3,865,047 A 2/1975 Hlinsky et al.
3,877,133 A 4/1975 Grube
3,885,299 A 5/1975 Hafner
3,900,937 A 8/1975 Schleicher
3,919,955 A 11/1975 DuVernay
3,920,059 A 11/1975 Grube
3,921,276 A 11/1975 Oaks
3,924,378 A 12/1975 Hafner
3,934,327 A 1/1976 Hafner
3,969,808 A 7/1976 Goodsmith et al.
3,981,064 A 9/1976 Hafner
3,999,659 A 12/1976 Grube
4,035,901 A 7/1977 Lux et al.
4,059,897 A 11/1977 Marquis
4,064,617 A 12/1977 Oaks
4,069,902 A 1/1978 Zdeb
4,094,352 A 6/1978 Hlinsky
4,153,989 A 5/1979 Shinjo
4,196,944 A 4/1980 Simatovich
4,203,187 A 5/1980 Grube
4,208,776 A 6/1980 Schleicher
4,237,567 A 12/1980 Grube
4,242,793 A 1/1981 Matthews et al.
4,269,248 A 5/1981 MacLean et al.
4,281,699 A 8/1981 Grube
4,306,511 A 12/1981 Ashby et al.
4,384,667 A 5/1983 Smallegan et al.
4,394,794 A 7/1983 Shirey
RE31,535 E 3/1984 Schleicher
4,459,735 A 7/1984 Sawdon
4,484,385 A 11/1984 Woods
4,525,912 A 7/1985 Kazino et al.
4,531,279 A 7/1985 Gunter
4,569,111 A 2/1986 Mutou
4,574,453 A * 3/1986 Sawdon ..... 29/432
4,574,473 A 3/1986 Sawdon
4,584,753 A 4/1986 Eckold et al.
4,601,090 A 7/1986 Gunter
4,610,072 A 9/1986 Müller
4,614,017 A 9/1986 Eckold et al.
4,633,559 A 1/1987 Loren
4,658,502 A 4/1987 Eckold et al.
4,660,403 A 4/1987 Slasinski
4,688,316 A 8/1987 LaBarge et al.
4,722,647 A 2/1988 Sawdon
4,752,993 A 6/1988 Oaks
4,757,609 A 7/1988 Sawdon
4,803,767 A 2/1989 Obrecht et al.
4,825,525 A 5/1989 Obrecht et al.
4,831,704 A 5/1989 Rapp
4,878,284 A 11/1989 Sawdon
4,905,362 A 3/1990 Obrecht et al.
4,910,853 A 3/1990 Sawdon
4,928,370 A 5/1990 Eckhold et al.
4,930,203 A 6/1990 Obrecht et al.
4,947,719 A 8/1990 Whistler
4,972,565 A 11/1990 Eckold et al.
5,010,714 A 4/1991 Medwed et al.
5,027,503 A 7/1991 Sawdon
5,031,442 A 7/1991 Kynl
5,046,228 A 9/1991 Eckold et al.
5,051,020 A 9/1991 Schleicher
5,138,758 A 8/1992 Gubbiotti et al.
5,150,513 A 9/1992 Sawdon
5,155,897 A 10/1992 Schleicher
5,177,861 A * 1/1993 Sawdon ..... 29/798
5,207,086 A 5/1993 Kynl
5,208,973 A 5/1993 Sawdon
5,208,974 A 5/1993 Sawdon et al.
5,230,136 A 7/1993 Cronn et al.
5,259,102 A 11/1993 Obrecht
5,267,383 A 12/1993 Sawdon
5,305,517 A 4/1994 Schleicher
5,315,743 A 5/1994 Schleicher
5,338,599 A 8/1994 Barrett
5,339,509 A 8/1994 Sawdon et al.
5,408,735 A 4/1995 Schleicher
5,425,262 A 6/1995 Dubugnon
5,431,089 A 7/1995 Sawdon
5,432,989 A 7/1995 Turek
5,435,049 A 7/1995 Sawdon
5,438,897 A 8/1995 Chun
5,479,687 A 1/1996 Sawdon
5,490,310 A 2/1996 Schleicher
5,509,290 A 4/1996 Faivre
5,528,815 A 6/1996 Webb
5,581,860 A 12/1996 Sawdon
5,621,961 A 4/1997 Schleicher
5,622,442 A 4/1997 Schleicher
5,695,867 A 12/1997 Saitoh et al.
5,709,019 A 1/1998 Sawdon
5,727,302 A 3/1998 Sawdon
5,737,819 A * 4/1998 Sawdon et al. ..... 29/243.5
5,765,820 A * 6/1998 Marusiak ..... 269/6
5,782,130 A 7/1998 Sawdon
5,806,362 A 9/1998 Dubugnon
5,860,315 A 1/1999 Sawdon
5,938,099 A * 8/1999 Ciccarelli ..... 227/19
5,946,782 A 9/1999 Dubugnon et al.
5,984,563 A 11/1999 Wu
6,092,270 A 7/2000 Sawdon
6,115,898 A * 9/2000 Sawdon ..... 29/243.5
6,205,640 B1 3/2001 Dubugnon
6,430,794 B1 8/2002 McKee
6,430,795 B1 8/2002 Sawdon et al.
6,450,082 B1 9/2002 Sawdon
6,612,007 B1 9/2003 Wade
6,757,951 B2 7/2004 Sawdon et al.
6,785,959 B2 9/2004 Sawdon et al.
7,003,861 B2 2/2006 Sawdon et al.
8,141,227 B2 * 3/2012 Nishimura et al. ..... 29/524.1

(56) References Cited

U.S. PATENT DOCUMENTS

| | | | |
|---|---|---|---|
| 2004/0045153 | A1 | 3/2004 | Rapp |
| 2005/0252269 | A1 | 11/2005 | Sawdon et al. |
| 2006/0196034 | A1 | 9/2006 | Sawdon et al. |

FOREIGN PATENT DOCUMENTS

| | | | |
|---|---|---|---|
| CA | 2374217 | | 11/2000 |
| DE | 98517 | | 10/1897 |
| DE | 1452782 | | 3/1969 |
| DE | 1452650 | | 2/1973 |
| DE | 2852909 | | 6/1980 |
| DE | 3021332 | | 12/1981 |
| DE | 3210208 | | 11/1984 |
| DE | 3726392 | | 2/1989 |
| DE | 4214475 | A1 | 11/1993 |
| DE | 4317278 | | 12/1993 |
| DE | 4335318 | | 4/1994 |
| EP | 0642853 | | 3/1995 |
| FR | 2371252 | | 7/1978 |
| GB | 664979 | | 1/1952 |
| GB | 708236 | | 4/1954 |
| GB | 713625 | | 8/1954 |
| GB | 895561 | | 5/1962 |
| GB | 930164 | | 7/1963 |
| GB | 934101 | | 8/1963 |
| GB | 945110 | | 12/1963 |
| GB | 1008914 | | 11/1965 |
| GB | 1041119 | | 9/1966 |
| GB | 1101795 | | 1/1968 |
| GB | 1114826 | | 5/1968 |
| GB | 1202275 | | 8/1970 |
| GB | 1378534 | | 12/1974 |
| GB | 1551353 | | 8/1979 |
| GB | 2055648 | | 3/1981 |
| GB | 2069394 | | 8/1981 |
| GB | 2071000 | | 9/1981 |
| JP | 54-107868 | | 8/1979 |
| JP | 54-113753 | | 8/1979 |
| JP | 56-059540 | | 5/1981 |
| JP | 62-148035 | | 7/1987 |
| JP | 62-148036 | | 7/1987 |
| JP | 62-148039 | | 7/1987 |
| JP | 62-148040 | | 7/1987 |
| JP | 63-177931 | | 7/1988 |
| JP | 63-192524 | | 8/1988 |
| JP | 42-84928 | | 10/1992 |
| SU | 1299699 | | 3/1987 |
| WO | WO9115316 | | 10/1991 |
| WO | WO9218264 | | 10/1992 |
| WO | WO9314893 | | 8/1993 |
| WO | WO9422613 | | 10/1994 |
| WO | WO9520461 | | 3/1995 |
| WO | WO0136124 | | 5/2001 |
| WO | WO0176788 | | 10/2001 |

OTHER PUBLICATIONS

Attexor Clinch Systems SA, "Clinching Tool Kits," © 2002 [online], [retrieved on Oct. 28, 2008]. Retrieved from the Internet: http://www.clinchsystems.com/html.

Attexor Equipment, S.A., "Spot Clinch 67," 2 pages (prior to Jul. 22, 1994).

Attexor Supertagger, Sofort verbinden, ohne nieten, schrauben oder punktschweissen, 2 pages.

Böllhoff & Co, Verbindungs—und Montagetechnik, RIVSET® Stanzniettechnik, Standardsetzwerkzeuge, 2 pages.

Böllhoff & Co, Verbindungs—und Montagetechnik, RIVSET® Verbindung von Blechen und Profilen, 4 pages.

Böllhoff & Co, Verbindungs—und Montagetechnik, RIVSET-STANZNIETTECHNIK, Prozeβüberwachung, 4 pages.

Böllhoff & Co, Verbindungs—und Montagetechnik, Systembeschreibung, RIVSET Magazinierte Stanzniete, 4 pages.

Böllhoff zum Thema Stanznieten, Warum sollen wir uns selbst loben, 4 pages.

BTM—Punch Tech Brochure, published Sep. 1983, 4 pages.

BTM Corporation Engineering Standards Manual—Section: D, Tog-L-Loc/Lance-N-Loc Information, Revised: Dec. 16, 2008 Rev 11, 46 pages.

BTM Corporation, "Typical Tog-L-Loc® Design Configurations," © 2009 BTM Corporation, [online], [retrieved on Feb. 2, 2009]. Retrieved from the Internet: htp://www.btmcorp.com/tlconfigure.html, 4 pages.

BTM Lance-N-Loc and Tog-L-Loc Brochure, published prior to May 10, 1994, 1 page.

BTM's Tog-L-Loc and Lance-N-Loc Brochure, "Sheet Metal Joining Systems," published 1999. 16 pages.

De-Sta-Co, Durchsetzfüge—Technik Brochure, published 1993, 4 pages.

J.M. Sawhill, Jr. and S.E. Sawdon, A New Mechanical Joining Technique for Steel Compared with Spot Welding, SAE Technical Paper Series 830128, Feb. 28-Mar. 4, 1983, 16 pages.

Pressotechnik GmbH, "TOX Druckfugetechnik," 2 pages, (prior to Jul. 22, 1994).

Pressotechnik, "TOX Sammanfogningssystem," 2 pages, (prior to Jul. 22, 1994).

Pressotechnik, "TOX-Clinch Technik," 4 pages, (prior to Jul. 22, 1994).

*Tool Engineers Handbook*, American Society of Tool Engineers Handbook Committee, Detroit MI, First Edition, 1949, Section 97 (Punches and Dies) and Section 98 (Jigs and Fixtures), 86 pages.

TOX—Sheet Metal Joining System: Riveting without Rivets Brochure, published Sep. 2005, 24 pages.

TOX publication 262 Nr 4.1 entitled "Werkzeuge and Werkzeugkenngroβen," "Neue Verbindungs-Verfahren im Vergleich," 2 pages (prior to Jul. 22, 1994).

TOX® Pressotechnick L.L.C., "Overview of the TOX®-Clinching Technology—Data Sheet 80.100;" May 2008; 24 pages.

BTM® Corporation; "Tog-L-Loc® Sheet Metal Joining System—Operating & Maintenance Manual;" 1988; 17 pages.

* cited by examiner

CLINCHING TOOL

BACKGROUND AND SUMMARY

The present invention relates generally to metal working and more particularly to a clinching tool.

It is well known to join sheet metal workpieces together by way of a clinch joint. Such a clinch joint is formed by a punch and die deforming workpieces in an interlocking manner. Exemplary clinch joints and tooling are disclosed in the following U.S. Patents and Patent Publication Nos.: 2006/0196034 entitled "Sheet Fastening Apparatus and Method;" U.S. Pat. No. 7,003,861 entitled "Tool Assembly Employing a Flexible Retainer;" U.S. Pat. No. 6,092,270 entitled "Die for Forming a Joint;" and U.S. Pat. No. 5,435,049 entitled "Apparatus for Joining Sheet Material;" all of which were invented or co-invented by the inventor of the present application and are incorporated by reference herein.

Various actuators have been used to advance punches relative to clinching dies. One such conventional actuator is a pneumatically powered motor, disclosed in U.S. Pat. No. 3,730,044 entitled "Fluid Operated Apparatus" which issued to Sawdon on May 1, 1973, and is incorporated by reference herein. Furthermore, there has been a desire to reduce the width of workpiece flanges in order to save material costs, weight and space. Such a reduced width flange, however, makes fastening the workpieces together at the flange much more difficult given the size and function of traditional clinching tools.

In accordance with the present invention, a clinching tool is provided. A further aspect of the present application locates an anvil and/or movable die members closer to one lateral outside surface of a die body than the opposite lateral outside surface. In another aspect, a tool is employed which can create a clinch joint on a narrow width workpiece flange. In yet another aspect, an offset clinch die and pneumatic tool are employed. Another aspect of the present application includes a die body having an anvil and two linearly movable die members which essentially surround a lateral outside surface of the anvil when in inward positions. A method of clinching is also disclosed.

The present invention is advantageous over prior constructions since the present clinching tool is capable of creating a clinch joint on a much narrower width workpiece flange. Furthermore, the present clinching tool is advantageously robust, durable and protects the internal moving parts within a die body. The present clinching tool is also less complex than various traditional constructions and is thereby relatively simple to disassemble for maintenance and cleaning. Moreover, the specific die blade and die body shapes used with various aspects of the present clinching tool advantageously deter die blade rotation, misalignment and binding during clinching yet provide interlocking engagement between the die blades, anvil and die body. Additional advantages and features of the present invention will become apparent from the following description and appended claims, taken in conjunction with the accompanying drawings.

DETAILED DESCRIPTION

Figure 1:
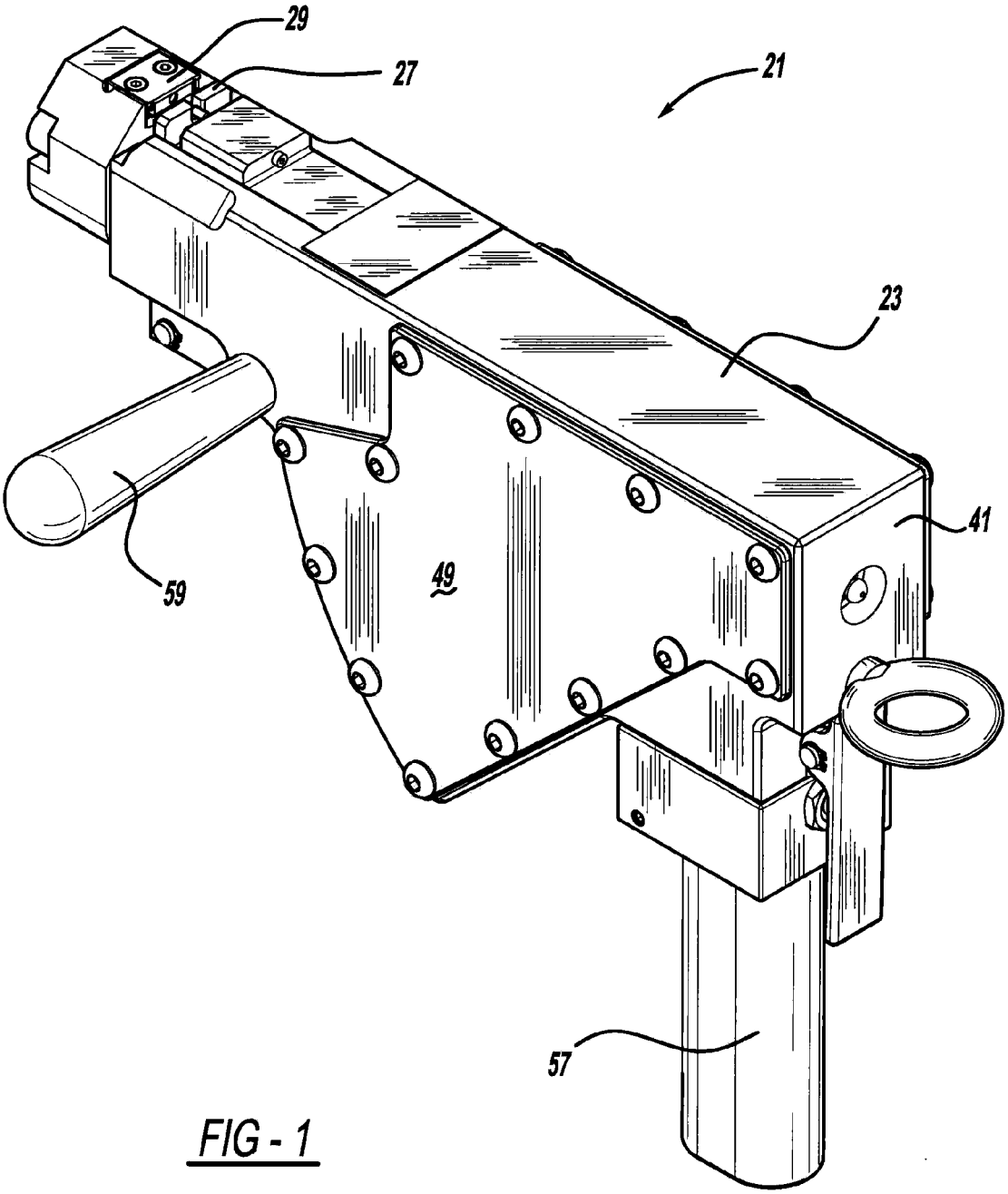
FIG. 1 is a perspective view showing a clinch gun of a clinching tool.
Figure 2:
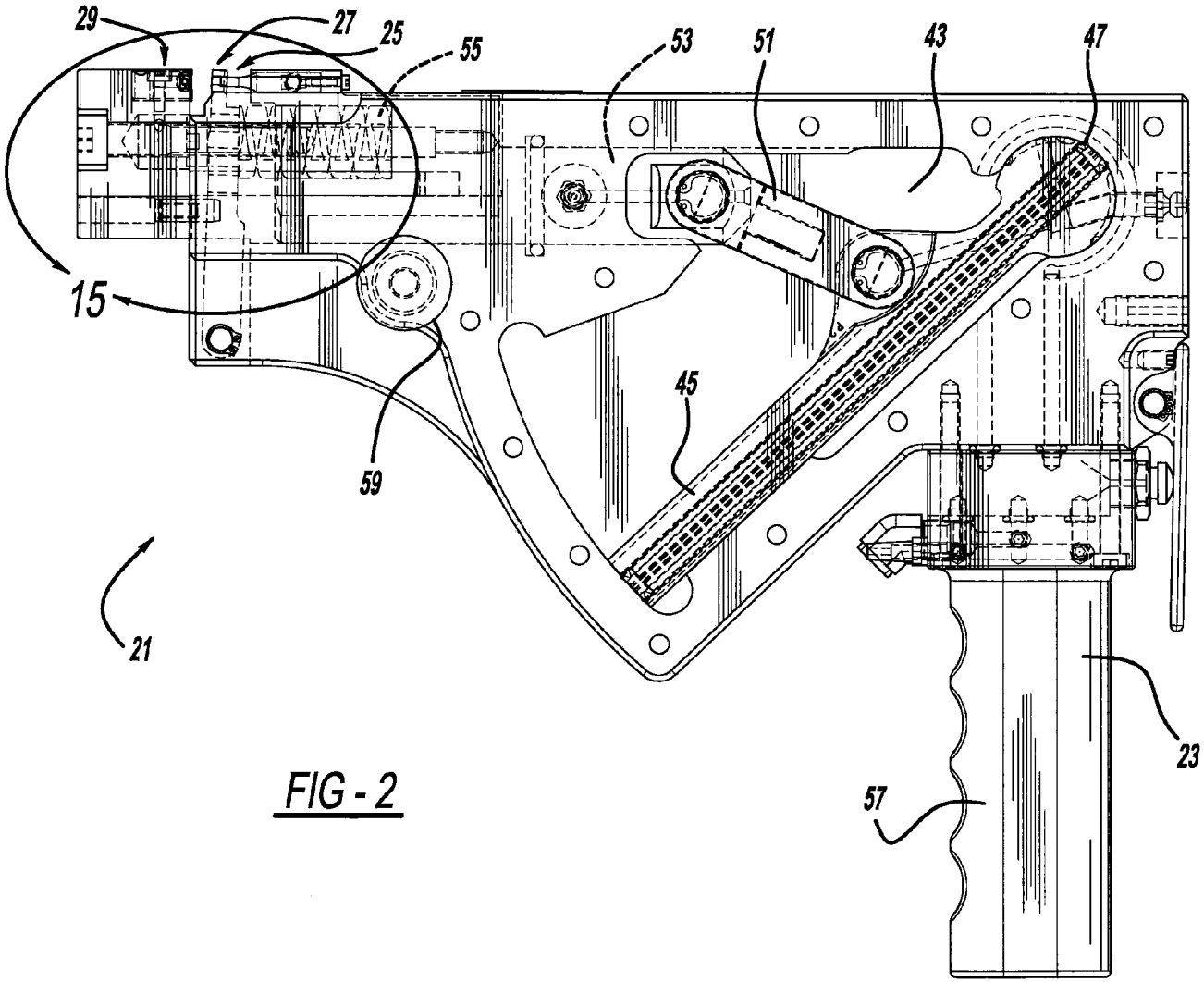
FIG. 2 is a side elevational view showing the clinch gun of FIG. 1, but with an outside plate removed.

The preferred embodiment of a clinching tool 21 of the present application is shown in FIGS. 1, 2, 3, 15 and 16. Clinching tool 21 includes a hand-held clinch gun 23, a punch 25, a stripper 27 and a die assembly 29. Two or more sheet metal workpieces 31 each have a nominal planar surface 33 and an offset angled flange 35. Clinching tool 21 operably forms a leakproof, clinched joint 37 at the flange of the workpieces 31 as will be further discussed hereinafter.

Clinching gun 23 includes an aluminum body 41 having an internally machined chamber 43 within which rotates a cast piston 45. Elastomeric seals 47 encircle piston 45 and seal against outer plates 49 screwed onto body 41. Movement of piston 45 serves to rotate a link 51 pivotally attached to a middle thereof. Link 51 is further pivotally coupled to a linearly moving ram 53 and ram 53, in turn, linearly drives punch 25. Ram 53 also drives stripper 27 by way of a compression spring 55. Pneumatic pressure advances and retracts piston 45. Handles 57 and 59 are also mounted to body 41 to allow for manual positioning of the clinch gun relative to the workpieces. It should be appreciated, however, that clinch gun 23 may alternately be a stationary part of a statically mounted machine or attached to the end of a movable robotic arm.

Referring to FIGS. 4-8, die assembly 29 includes a generally rectangular parallelepiped-shaped die body 61, an anvil 63, a pair of die blades 65, blade retainers 67 and compression springs 69. Dowels, bolts, set screws or other fasteners are used to mount the die assembly onto the clinch gun by way of countersunk holes 71 or the like. Die body 61 has a cavity 73 with a laterally elongated and generally semi-circular first branch. A circular groove 75 is machined into cavity 73 adjacent each outboard lateral end. Furthermore, a recess 77 is machined into the internal sides of cavity 73 immediately outboard of each groove 75. Each blade retainer 67 is inserted into its corresponding groove 75 and then moved into its associated recess 77 when assembled. Additionally, a second branch 79 of cavity 73 is internally machined in die body 67 so as to intersect a middle of the laterally extending branch.

Cylindrically-shaped anvil 63 is stationarily mounted within second branch 79 of cavity 73. The height of a workpiece engaging surface 81 of anvil 63 may vary relative to a workpiece-accessible top surface 83 of die body 61 depending on the workpiece material type, thickness and number of workpieces employed. A set screw, dowel, roll pin or the like may optionally be used to secure anvil 63 within die body 61. A knock out hole coaxially extends from second branch 79 to allow for removal of anvil 63 from die body 61. Die body is preferably machined from 4150 steel.

FIGS. 4-7, 10 and 11 show further details of each blade 65. Each die blade 65 has a generally flat workpiece-contacting top surface 91, and a cavity-engaging side and bottom surface 93 defining a slightly greater than semi-circular shape. Furthermore, each die blade 65 has a generally semi-circular anvil-engaging end 95 and an opposite generally flat end 97 with a cylindrical bore 99 machined therein. A portion of compression spring 69 is received within bore 99. The surface defining the first branch of cavity 73 of die body 61 is actually slightly greater than a semi-circular shape to match side and bottom surfaces 93 of each die blade 65, thereby trapping the die blades within the cavity in an interlocking manner yet allowing smooth and non-binding inboard-outboard linear movement of the die blades toward and away from anvil 63. In other words, each die blade 65 slides in a linear and non-rotational direction. Each die blade is preferably machined from 4150 steel and anvil 63 preferably machined from M2 steel which is heat treated and hardened.

Figure 3:
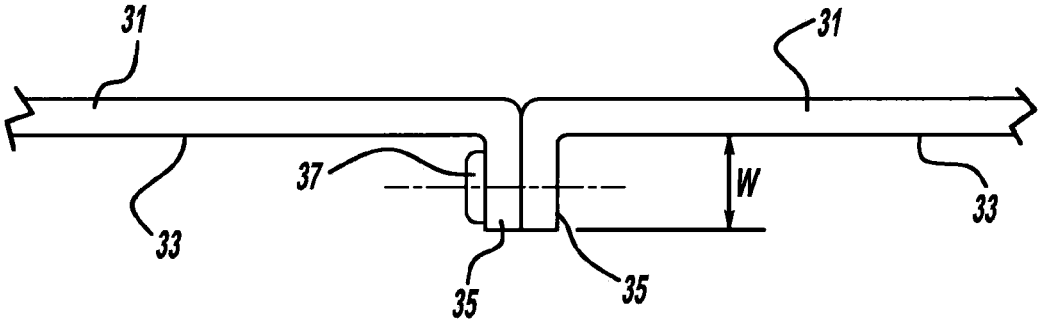
FIG. 3 is a side elevational view showing workpieces joined by a clinch joint employing the clinching tool.
Figure 4:
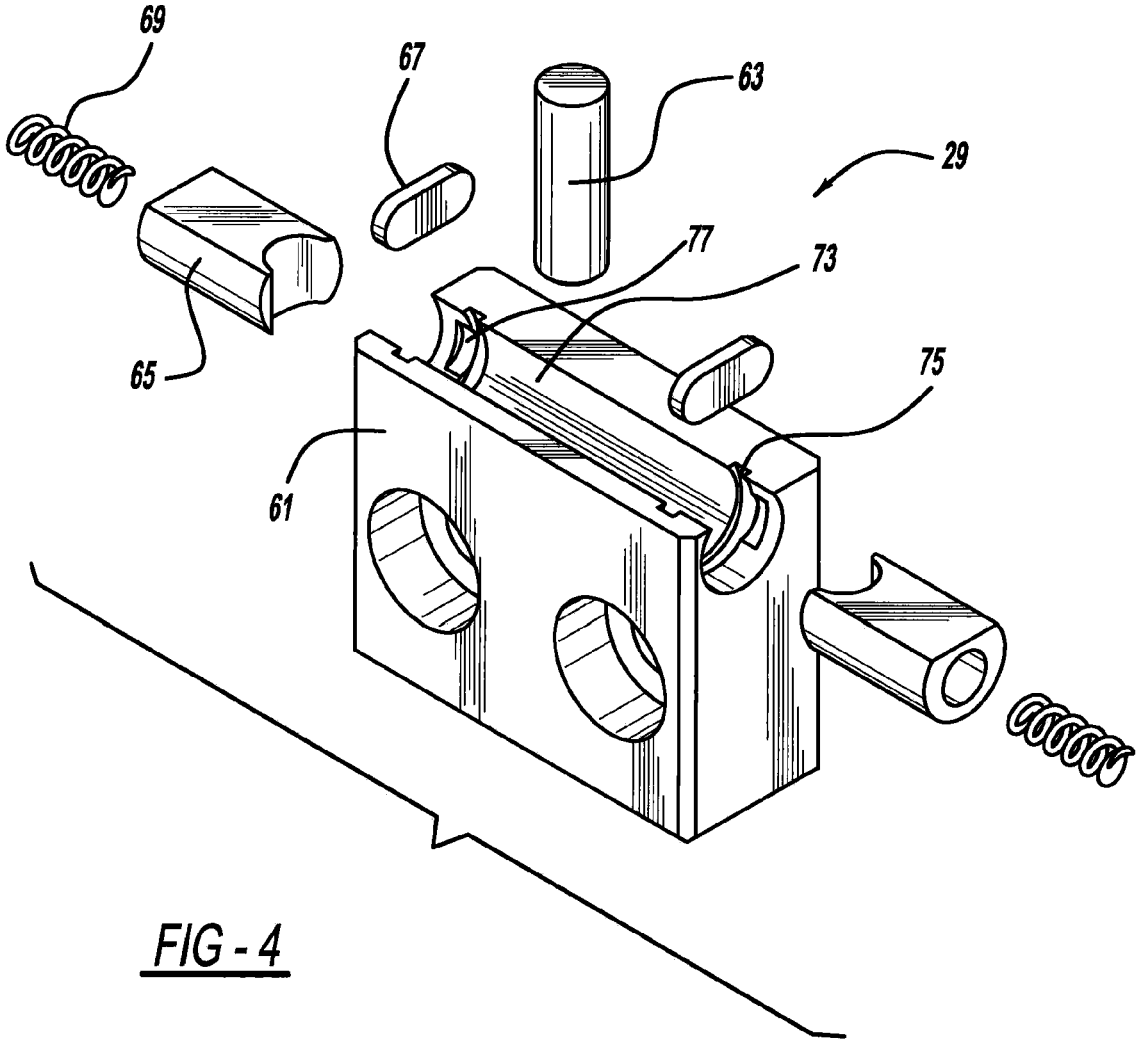
FIG. 4 is an exploded perspective view showing a preferred embodiment of a die assembly employed in the clinching tool.
Figure 5:
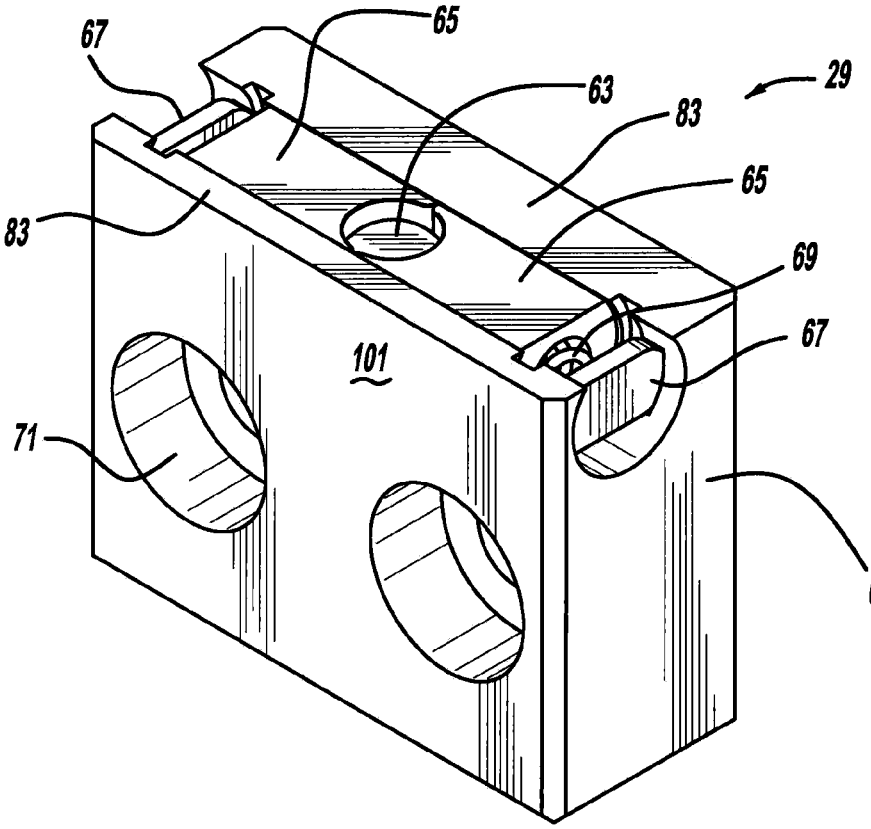
FIG. 5 is a perspective view showing the preferred embodiment die assembly.
Figure 6:
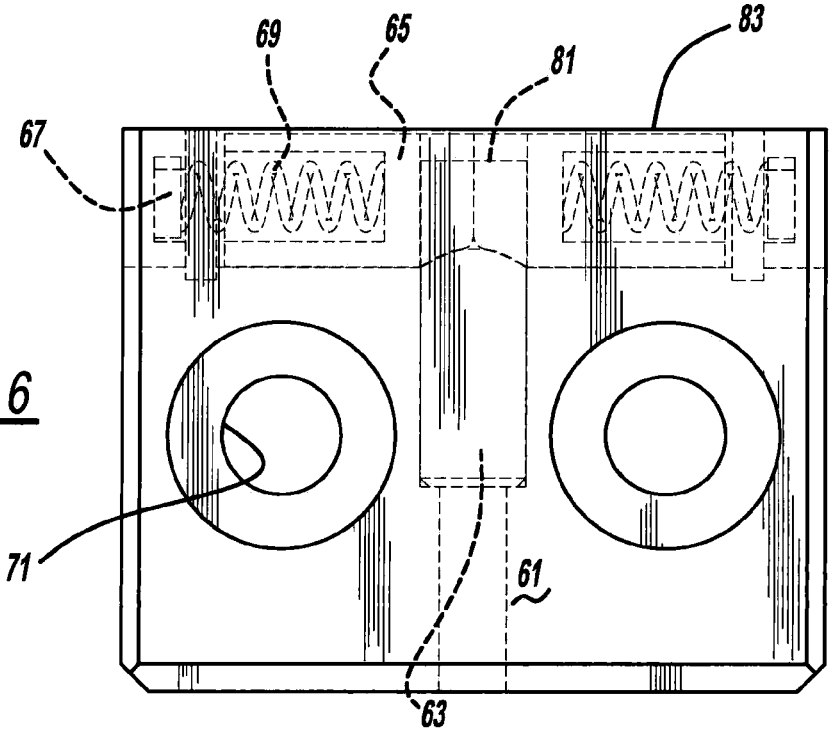
FIG. 6 is a side elevational view showing the preferred embodiment die assembly.
Figure 7:
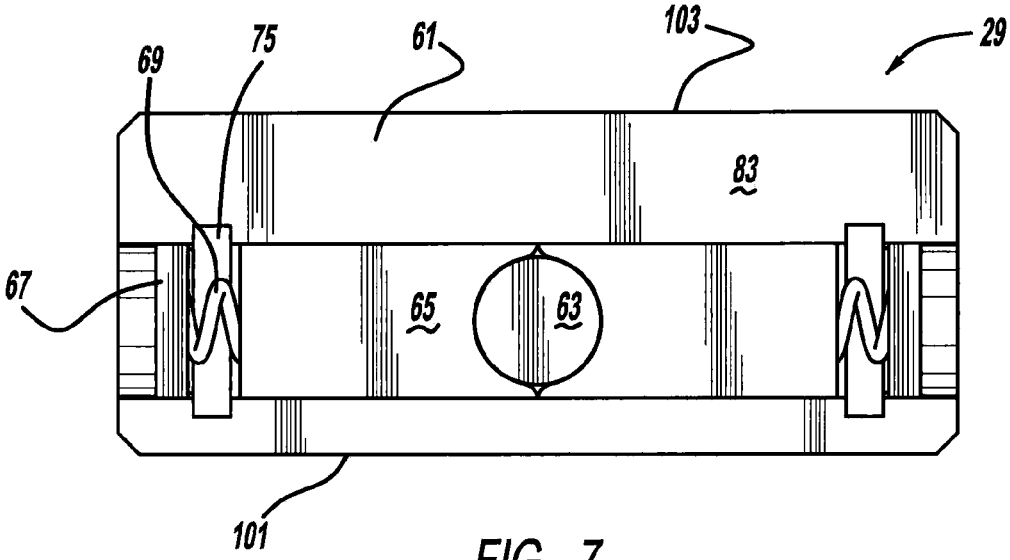
FIG. 7 is a workpiece-accessible, top elevational view showing the preferred embodiment die assembly.
Figure 8:
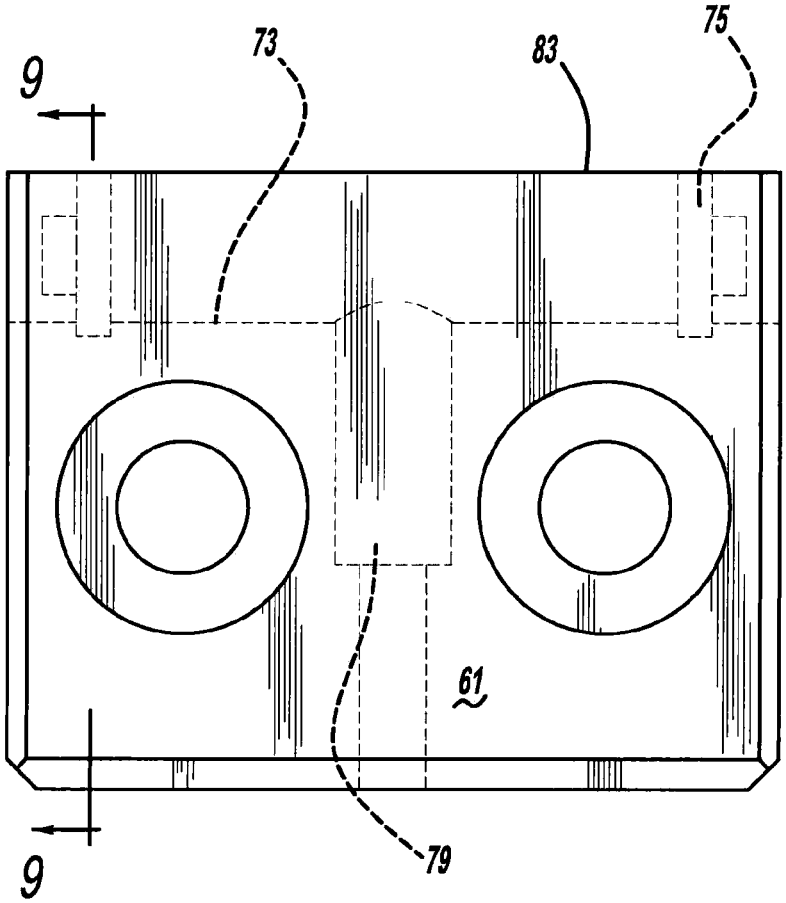
FIG. 8 is a side elevational view, like that of FIG. 6, showing a die body employed in the clinching tool.
Figure 9:
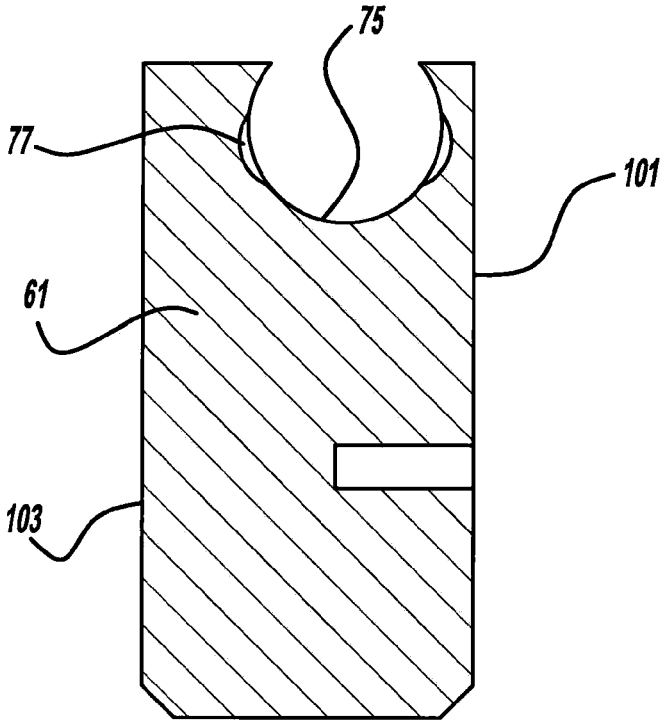
FIG. 9 is a cross sectional view, taken along line 9-9 of FIG. 8, showing the preferred embodiment die body.
Figure 10:
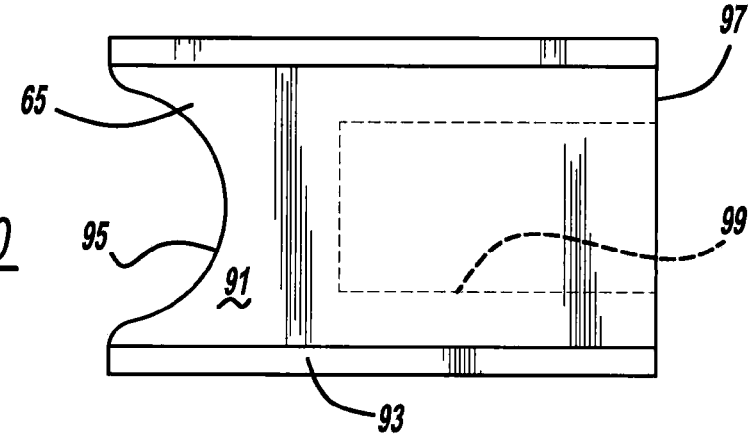
FIG. 10 is a top elevational view showing a preferred embodiment die blade employed in the clinching tool.
Figure 11:
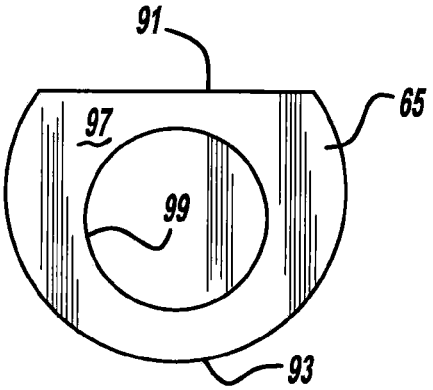
FIG. 11 is an end elevational view showing the preferred embodiment die blade.

As can best be observed in FIGS. 3, 5 and 7, the preferred embodiment of clinching tool 21 locates anvil 63 and die blades 65 in a laterally offset manner (as viewed from the top) within die body 61. In other words, anvil 63 and die blades 65 are closer to a first and generally flat outside surface 101 of die body 61 as compared to the opposite outside surface 103. First surface 101 is operably placed immediately adjacent to nominal planar surface 33 of workpiece 31 during clinching. This allows anvil 63 and die blade 65 to act in concert with the punch to form clinch joint 37 onto a flange that is as small as 6.3-9.9 millimeters in width W, and even more desirably on a flange between 6.3-8 millimeters in width. Thus, the upper land of workpiece-accessible top surface 83 adjacent second surface 103 is at least twice as wide as the co-planar upper land of surface 83 adjacent first surface 101, thereby providing additional contact area for the workpieces against the die body. It is also noteworthy that top surface 83 extends beyond the adjacent upper surfaces of anvil 63 and die blades 65 such that the anvil, die blades, springs and retainers are all well protected within the die body 61.

Figure 12:
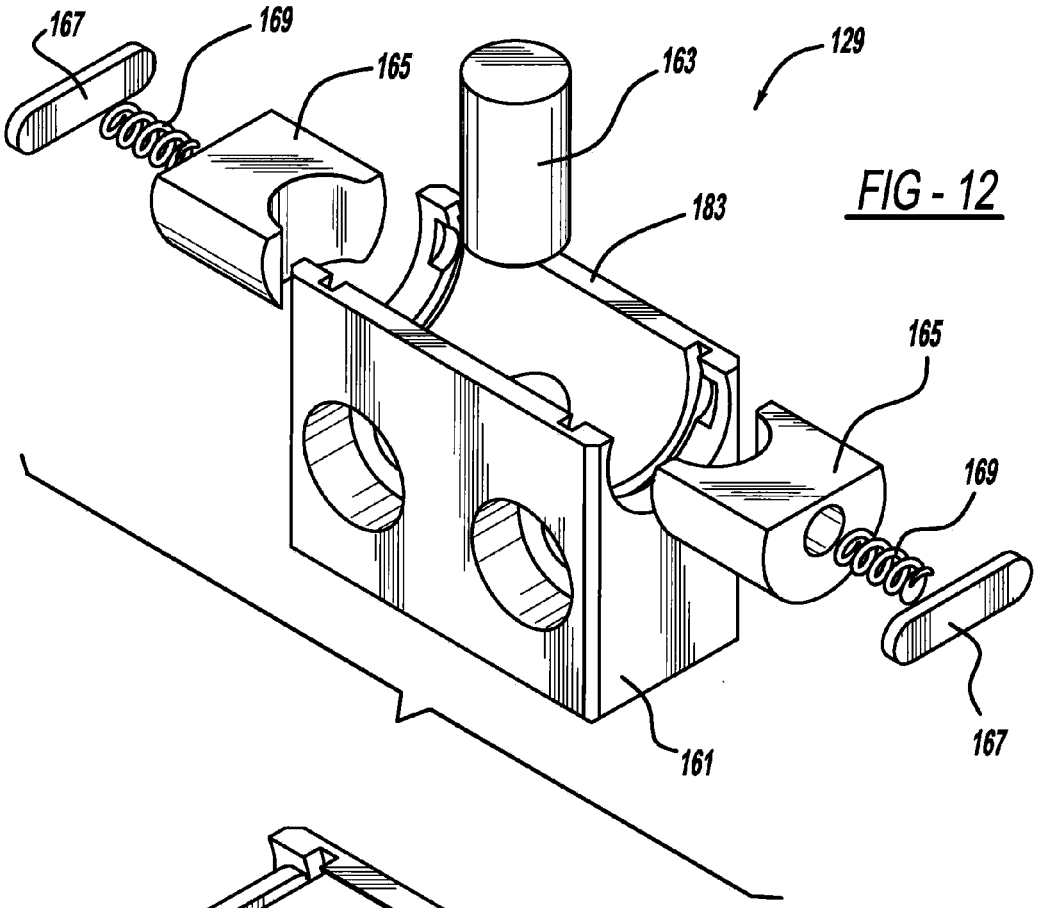
FIG. 12 is an exploded perspective view showing an alternate embodiment die assembly employed in the clinching tool.
Figure 13:
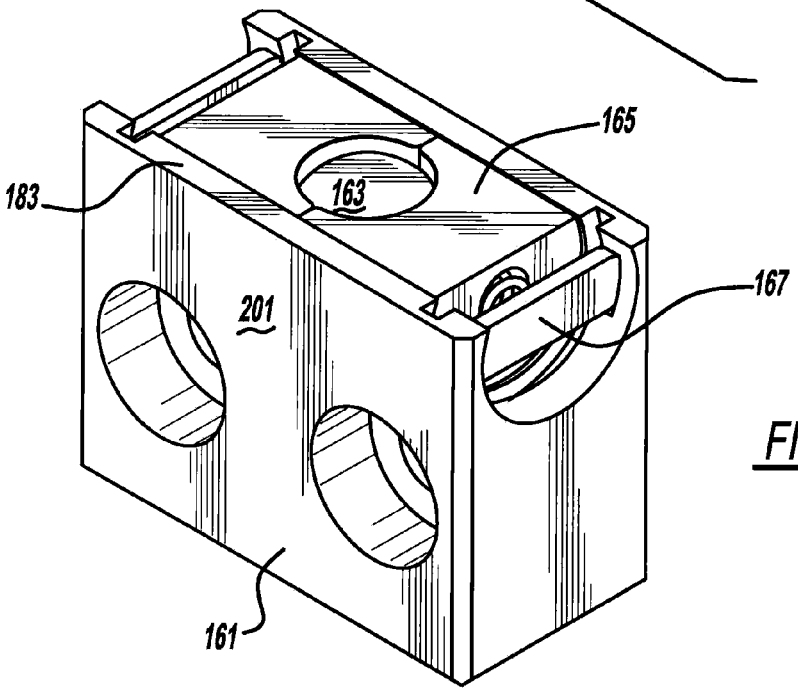
FIG. 13 is a perspective view showing the alternate embodiment die assembly.
Figure 14:
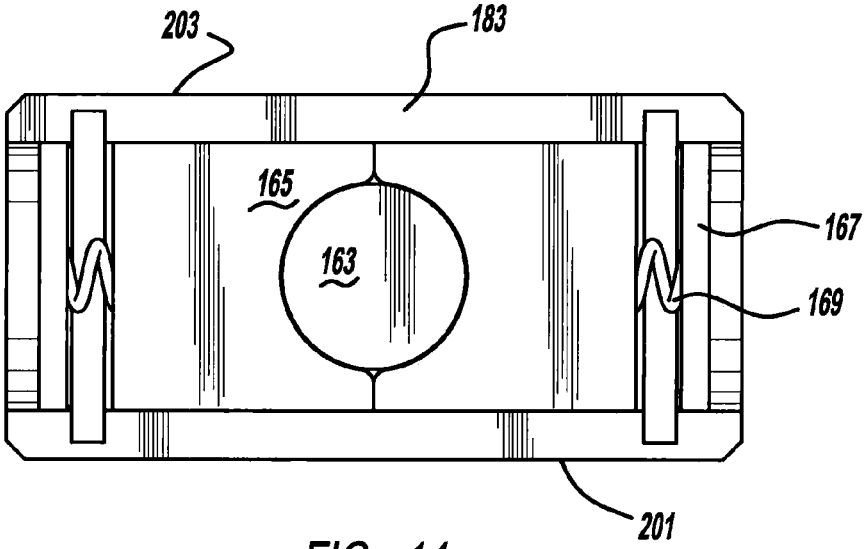
FIG. 14 is a workpiece-accessible, top elevational view showing the alternate embodiment die assembly.
Figure 15:
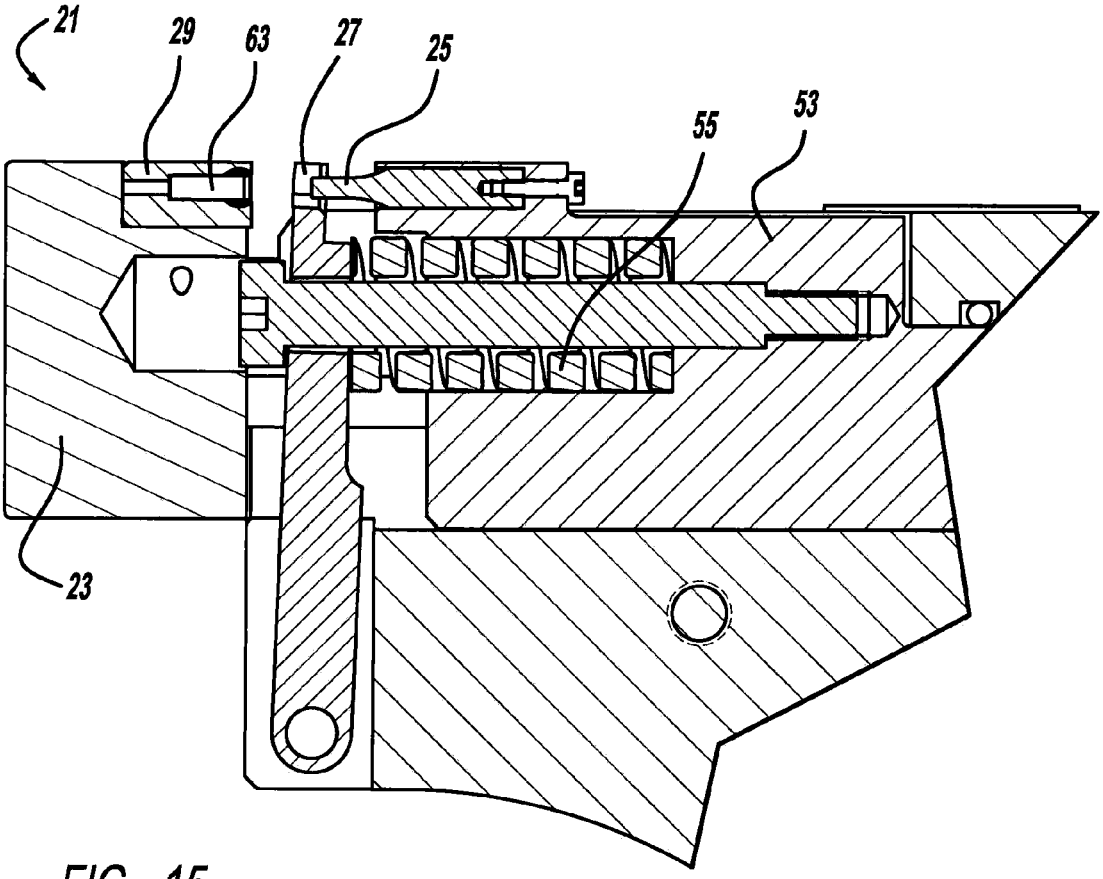
FIG. 15 is a fragmentary and enlarged view, taken within circle 15 of FIG. 2, showing a punch located in a retracted position relative to the preferred embodiment die assembly employed in the clinching tool.
Figure 16:
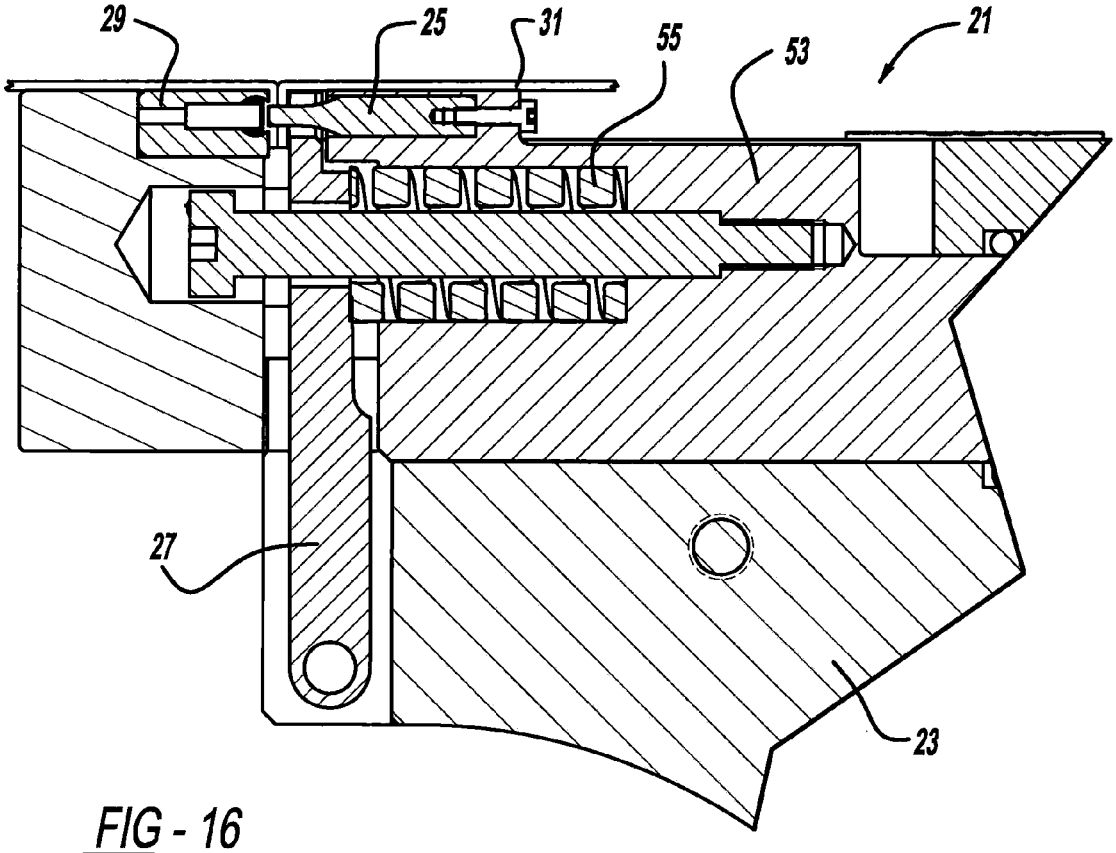
FIG. 16 is a fragmentary and enlarged view, like that of FIG. 15, but showing the punch in an advanced and clinching position relative to the preferred embodiment die assembly.
Figure 17A:
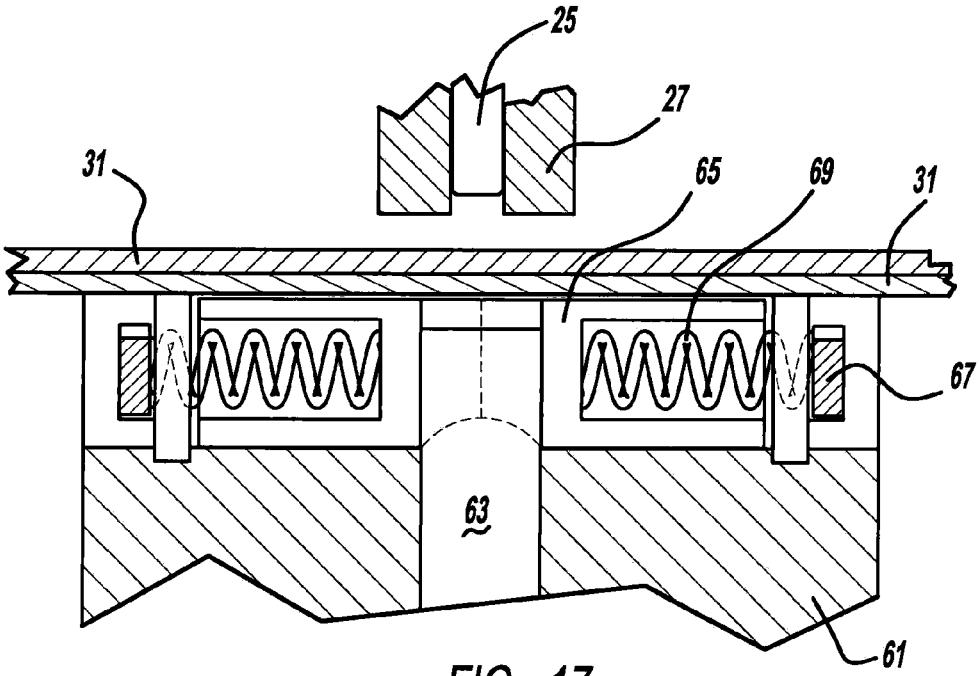
FIGS. 17*a*-17*c* are a series of fragmentary views showing the clinching tool and workpieces in various states of clinch forming.
Figure 17B:
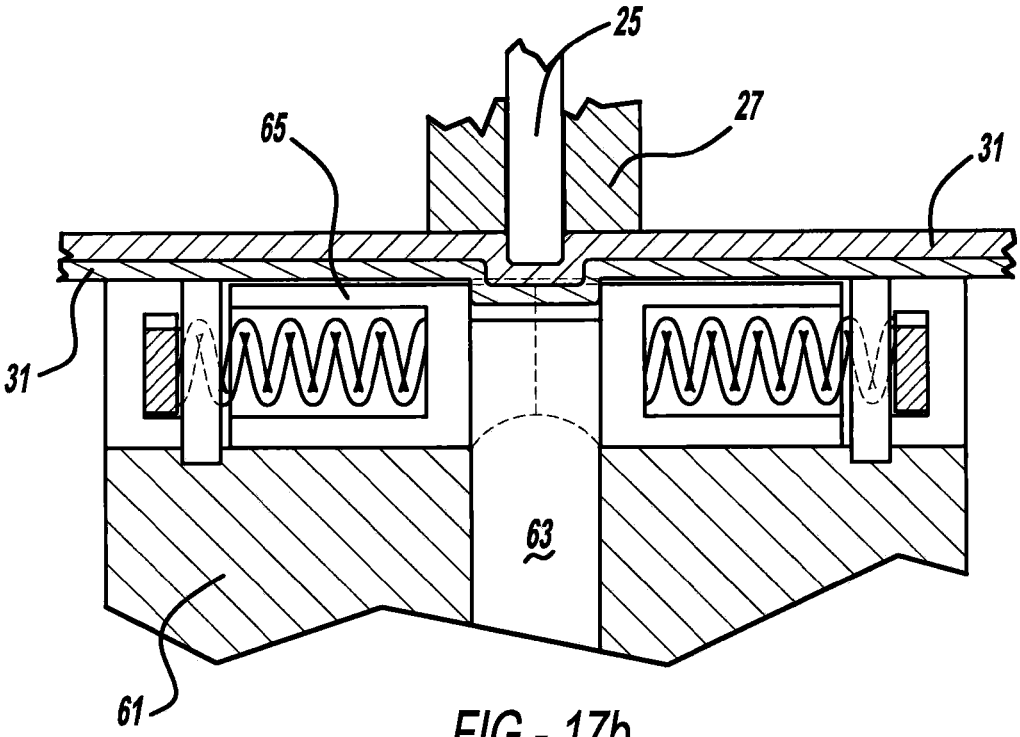
Figure 17C:
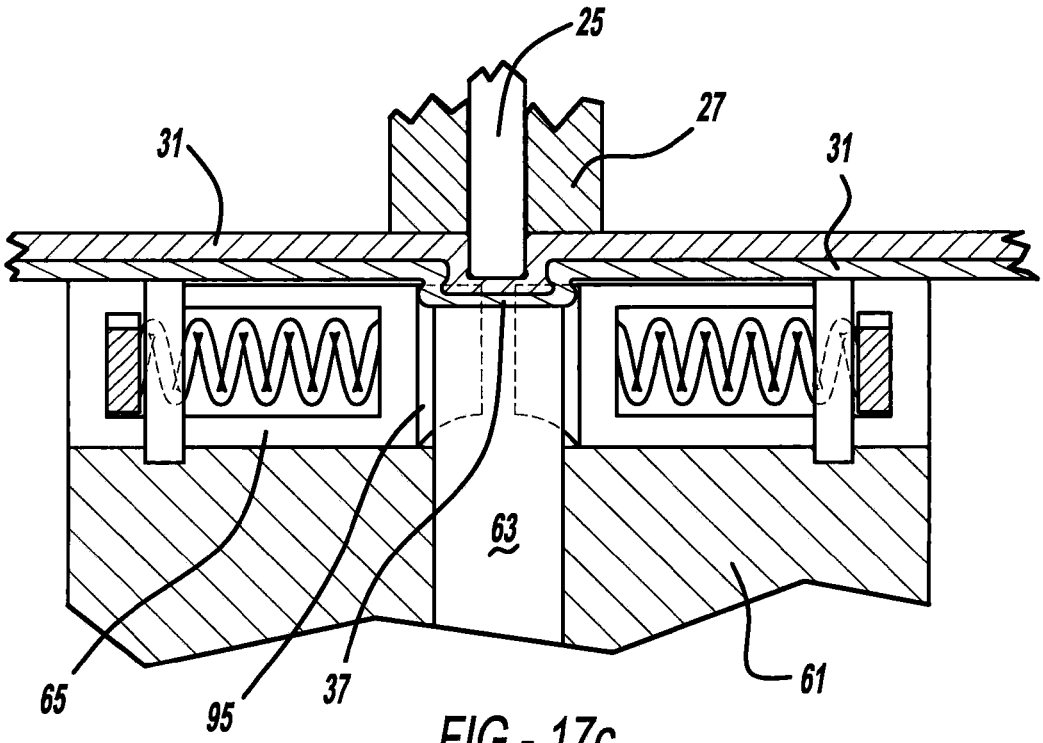

An alternate embodiment of a die assembly 129 employed in clinching tool 21 is illustrated in FIGS. 12-14. This alternate embodiment die assembly 129 includes a die body 161, anvil 163, die blades 165, blade retainers 167 and compression springs 169, much like that of the preferred embodiment. With this alternate embodiment, however, anvil 163 and die blades 165 are centered between opposite flat outside surfaces 201 and 203 of die body 161. Thus, the workpiece supporting lands upon top surface 183 of die body 161 are generally of equal width, yet small enough to accommodate the preferred small flange widths of the workpieces. This equal land width allows for reversible positioning when attaching the die assembly to the clinching tool.

The clinching operation will now be discussed with regard to FIGS. 15-17*c*. Workpieces 31 and clinching tool 21 are positioned relative to each other such that the workpiece flange is inserted between the spaced apart punch 25 and die assembly 29 (see FIGS. 15 and 17*a*). Punch 25 is then linearly advanced toward anvil 63 while workpieces 31 rest against the top surface 83 of die body 61. An end of punch 25 thereafter pushes the adjacent surface of workpieces 31 thereby deforming them into the space between ends 95 of die blade 65 before contact with anvil 63 (see FIG. 17*b*). Punch 25 continues advancing and then compresses workpieces 31 against an opposing top end of anvil 63. This causes radially outward expansion and interlocking of the workpieces between die blades 65 while die blades 65 are laterally and strictly linearly moved away from the adjacent lateral surfaces of anvil 63. This movement compresses die blade 65 against springs 69 (see FIGS. 16 and 17*c*). Accordingly, the interlocked and cup-shaped button of a leakproof, clinch joint 37 is thereby formed by clinching tool 21.

Adjusting the size of the clinched joint head or "BD" button diameter is determined by the penetration depth of punch 25. This is accomplished by using various length punches until the desired button diameter is reached. The length of anvil 63 will be chosen according to the metal thickness combination to be joined. Stripper 27 thereafter acts to hold the clinched and fastened workpieces 31 while punch 25 is retracted. Then, workpieces 31 are removed from die assembly 29 and springs 69 are allowed to urge die blade 65 back toward anvil 63.

While various embodiments of the present invention have been disclosed, it should be appreciated that other modifications are possible. For example, alternate actuators for the punch may be employed although various advantages of the present application may not be realized. Furthermore, alternate springs or other biasing devices can be used to achieve the same function disclosed hereinabove although various advantages may not be realized. It is also envisioned to employ differing shaped die blades and die bodies although many advantageous aspects of the present application may not be achieved. Use of the clinching tool on offset workpiece flanges is the most advantageous use, however, other workpiece joint configurations can be employed. Moreover, the references hereinabove to "top," "side," "bottom," "end," "first" and "second" are merely relative and nonlimiting terms since the referenced parts may be reoriented depending upon the specific utilization. Finally, while various materials and manufacturing processes have been disclosed, it should be appreciated that alternate materials and manufacturing processes may be used. It is intended by the following claims to cover these and any other departures from the disclosed embodiments which fall within the true spirit of this invention.

The invention claimed is:

1. A clinching tool comprising:

a die body;

a clinching anvil removeably mounted to the die body; and only two clinching die members operably sliding in a linear and non-rotational direction toward and away from lateral surfaces of the anvil, the die members being coupled to the die body;

the anvil being laterally offset closer to one outside surface of the die body than an opposite outside surface of the die body.

2. The clinching tool of claim 1, wherein the anvil has a cylindrical shape between the die members and the die members each have a circular end facing the anvil.

3. The clinching tool of claim 1, wherein the die members move away from the anvil during clinching in a strictly linear motion, parallel to the outside surface of the die body closest to the anvil.

4. The clinching tool of claim 1, further comprising a spring biasing each of the die members toward the anvil, the spring being located on an opposite end of the die member from the anvil, a bore in each die member receiving an end of the spring.

5. The clinching tool of claim 1, wherein the anvil is stationarily mounted within a cavity of the die body and the die members are movably located within the cavity, at least a section of the cavity being elongated substantially parallel to the one outside surface of the die body.

6. The clinching tool of claim 1, wherein the die members and anvil are all located below a workpiece-accessible surface of the die body.

7. The clinching tool of claim 1, wherein each of the die members includes a substantially flat workpiece-contacting surface, a substantially semi-circular anvil-contacting surface and a curved die body-contacting surface opposite the workpiece-contacting surface.

8. The clinching tool of claim 1, further comprising:

a clinch gun including a pneumatically driven piston; and a clinching punch having a substantially cylindrical workpiece-contacting end, the punch being advanced and retracted in response to movement of the piston;

the punch being coaxially aligned with the anvil in all operating conditions, the clinch gun securing the punch and die body adjacent a workpiece-accessible portion thereof.

9. The clinching tool of claim 1, wherein the anvil has a cylindrical side surface which is partly received in an internal bore of the die body.

10. The clinching tool of claim 1, wherein the die members are laterally offset closer to the one outside surface of the die body, and a clinch joint formed by the anvil and die members is an interlocking and leakproof joint with a substantially circular outside button shape.

11. A clinching tool comprising:

a die body including an elongated internal cavity;

a clinching anvil mounted to the die body;

two clinching die members laterally movable simultaneously toward and away from the anvil in strictly co-axial and linear directions, the die members being at least partially located within the cavity of the die body in an interlocking manner, to deter rotation of the die members; and a biasing member contacting against at least one of the die members.

12. The clinching tool of claim 11, wherein the die members move away from each other and the anvil during clinching, and the die members are laterally offset within the die body as viewed from a workpiece-accessible side of the die body.

13. A clinching tool comprising:

a die body including an elongated internal cavity;

an anvil mounted to the die body;

two die members laterally movable toward and away from the anvil in a co-axial and linear direction, the die members being at least partially located within the cavity of the die body in an interlocking manner; and a biasing member urging each of the die members toward the anvil, the biasing member being located on an opposite end of the die member from the anvil.

14. A clinching tool comprising:

a die body including an elongated internal cavity;

an anvil mounted to the die body; and two die members laterally movable toward and away from the anvil in a co-axial and linear direction, the die members being at least partially located within the cavity of the die body in an interlocking manner;

wherein the anvil is stationarily mounted within the cavity of the die body, closer to one substantially flat outside surface of the die body than an opposite outside surface of the die body.

15. The clinching tool of claim 11, wherein the die members and anvil are all located below a workpiece-accessible surface of the die body.

16. The clinching tool of claim 11, wherein each of the die members include a substantially flat workpiece-contacting surface, a substantially semi-circular anvil-contacting surface and a curved cavity-contacting surface opposite the workpiece-contacting surface.

17. A clinching tool comprising:

a die body including an elongated internal cavity;

a clinching anvil mounted to the die body;

two clinching die members laterally movable toward and away from the anvil in a co-axial and linear direction, the die members being at least partially located within the cavity of the die body in an interlocking manner, to deter rotation of the die members;

a clinch gun including a piston; and a clinching punch having a substantially cylindrical workpiece-contacting end, the punch being advanced and retracted in response to movement of the piston;

the punch being coaxially aligned with the anvil, the clinch gun securing the punch and die body adjacent a workpiece-accessible portion thereof.

18. A clinching tool comprising:

a die body;

only two die blades moveably coupled to the die body and the die blades being moved away from each other during clinching;

an anvil being laterally offset closer to one outside surface of the die body than the opposite surface of the die body;

a pneumatically driven piston; and a clinching punch having a workpiece-contacting end coaxially aligned with the anvil, the punch being advanced and retracted in response to movement of the piston.

19. The clinching tool of claim 18, wherein the die blades linearly move away from the anvil in a coaxial and strictly linear manner during clinching.

20. A clinching tool comprising:

a body;

a clinching anvil mounted to the body;

a pair of clinching die blades being linearly movable relative to the anvil, the die blades being movably coupled to the body, each of the die blades being laterally elongated in the direction of the linear movement and including a semi-circular end, the semi-circular ends of the die blades substantially surrounding a lateral surface of the anvil when the die blades are located in their inward positions;

a retainer substantially blocking a lateral end of a channel in the body within which the die blades move; and a biasing member located between the retainer and an end of an associated die blade opposite the anvil;

wherein the die blades move away from each other and the anvil during clinching, and the die blades are laterally offset within the body as viewed from a workpiece-accessible side of the body.

21. The clinching tool of claim 20, wherein the body has a substantially rectangular outside shape when viewed from a workpiece-accessible surface thereof.

22. The clinching tool of claim 20, wherein the retainer is removably located within a groove of the body.

23. The clinching tool of claim 20, wherein:

the anvil and the die blades are offset closer to one lateral outside surface of the body than an opposite outside surface of the body, when viewed from a workpiece-accessible surface of the body, the body having outside walls that extend beyond the anvil and die blades; and a clinch joint formed by the anvil and die blades is an interlocking and leakproof joint with a substantially circular outside button shape.

24. The clinching tool of claim 20, wherein the anvil is stationarily mounted to the body.

25. A clinching system comprising:

(a) a clinching tool comprising:

an anvil; and die members operably movable toward and away from the anvil in a strictly linear manner; and (b) at least two workpiece sheets including a nominal planar section and an offset flange, a portion of the flange being compressed against the anvil and the die members during the formation of a clinch joint between the workpiece sheets, wherein the flange is less than 8 millimeters wide adjacent the die members;

wherein the anvil is stationarily mounted within a first section of a cavity of the die body and the die members are movably located within a second section of the cavity, and the second section is elongated substantially parallel to the one outside surface of the die body.

26. The clinching system of claim 25, further comprising a substantially rectangular die body as viewed from a workpiece-accessible surface thereof, the anvil being laterally offset closer to one outside surface of the die body than the opposite surface of the die body.

27. A clinching system comprising:

(a) a clinching tool comprising:

an anvil; and die members operably movable toward and away from the anvil in a strictly linear manner;

(b) a die body, the die members being coupled to and located closer to one lateral outside surface of the die body than an opposite outside surface of the die body, when viewed from a workpiece-accessible surface of the die body; and (c) at least two workpiece sheets including a nominal planar section and an offset flange, a portion of the flange being compressed against the anvil and the die members during the formation of a clinch joint between the workpiece sheets, wherein the flange is less than 8 millimeters wide adjacent the die members.

28. The clinching system of claim 25, wherein there are only two die members and the die members move away from each other along a co-axial line during clinching.

29. The clinching tool of claim 11, wherein the anvil is stationarily secured within a bore of the die body but is removeable therefrom.

30. The clinching tool of claim 11, wherein a section of the anvil upstanding between the die members is cylindrical and surfaces of die members facing the anvil are semi-circular.

31. The clinching tool of claim 11, wherein the biasing member is a compression spring.

32. The clinching system of claim 25, further comprising a biasing member urging at least one of the die members toward the anvil.

33. The clinching system of claim 27, wherein the anvil is stationarily mounted within a first section of a cavity of the die body and the die members are movably located within a second section of the cavity, and the second section is elongated substantially parallel to the one outside surface of the die body.

* * * * *